United States Patent [19]

Bonca

[11] 4,303,130

[45] Dec. 1, 1981

[54] ALL TERRAIN DRILL UNIT

[75] Inventor: Aaron Bonca, Scarborough, Canada

[73] Assignee: BOA Drilling Equipment, Inc., Toronto, Canada

[21] Appl. No.: 75,206

[22] Filed: Sep. 13, 1979

[30] Foreign Application Priority Data

Mar. 31, 1977 [GB] United Kingdom ..... 13561/77

[51] Int. Cl.[3] ..... E21C 11/02

[52] U.S. Cl. ..... 173/23; 173/27; 173/28

[58] Field of Search ..... 173/23, 27, 28

[56] References Cited

U.S. PATENT DOCUMENTS

| | | | |
|---|---|---|---|
| 2,594,098 | 4/1952 | Vanderzee | 173/27 X |
| 2,646,968 | 7/1953 | Curtis | 173/27 |
| 2,807,441 | 9/1957 | Sewell . | |
| 2,904,310 | 9/1959 | Leonard | 173/27 |
| 2,985,250 | 5/1961 | Goodrich et al. | 173/27 X |
| 3,017,935 | 1/1962 | Galbraith et al. | 173/27 X |
| 3,696,625 | 10/1972 | Alexander . | |
| 3,744,574 | 7/1973 | Carley | 173/27 |
| 3,815,689 | 6/1974 | Kuhl . | |
| 3,823,902 | 7/1974 | Bumueller . | |
| 3,835,940 | 9/1974 | Winter, Jr. . | |
| 4,068,728 | 1/1978 | Subrick | 173/27 |

*Primary Examiner*—Robert Mackey
*Attorney, Agent, or Firm*—Ridout & Maybee

[57] ABSTRACT

A self-propelled all terrain drill unit having propulsion means for the chassis, a drilling mast mounted on the latter for movement between horizontal and vertical positions and a drilling head carried by the mast wherein all major functions are performed hydraulically, the hydraulic functions being divided into two groups; those of propelling the vehicle to a drilling site and operating the drill at the site provided by a variable displacement pump and those of adjusting the position of the machine at the site and aligning and positioning the drilling head provided by an independent pump.

6 Claims, 8 Drawing Figures

ALL TERRAIN DRILL UNIT

FIELD OF THE INVENTION

This invention relates to an all terrain drill unit of the kind comprising an all terrain vehicle chassis carrying a drilling mast which may be moved between a horizontal position overlying the chassis and a vertical position at one end of the chassis, the vehicle chassis being used to bring the drill to a desired location and also carrying a power source for the drill.

BACKGROUND OF THE INVENTION

In conventional units of this kind, it has been known to carry out various of the vehicle functions using hydraulic motors or actuators, but the relatively high cost of such techniques has restricted their use to selected functions only. We have found however that the advantages gained by using hydrostatic drives for essentially all of the vehicle functions outweigh the extra cost involved, particularly in the respect that with proper application of conventional hydrostatic engineering techniques, we find that a more versatile and effective unit can be produced which is nevertheless substantially easier to operate than conventional units.

SUMMARY OF THE INVENTION

As compared with conventional units, a drill unit in accordance with the invention, in which all major functions are performed hydraulically, and in which the controls for these functions are appropriately integrated and interlocked, can have the advantages of being able to drill at any angle to the vertical (available conventional mobile drills of this type can only drill vertically), of being exceptionally simple to operate (most conventional units require extensive operator training), and reliability and easy maintenance in that all of the major drive parts may be readily available standard items. To this end, hydraulic drive units are used both to provide traction for the vehicle chassis and drive for the drilling unit; the use of a hydraulic drive in the drilling head eliminates the need for the mechanical drive conventionally used for this purpose and enables the drilling head to be operated at any angle to the vertical at full efficiency.

Moreover, the use of hydraulic operation enables exceptionally simple controls to be utilized. In accordance with a further feature of the invention, a single pump controlled by a lever with a central neutral position is preferably utilized to determine the rate of forward and reverse movement of the vehicle in accordance with the degree of forward or rearward movement of the lever which is connected to appropriate proportioning valves in hydraulic circuits of the vehicle. By means of another control, the output of this pump may be switched so that instead of determining forward and reverse movement of the vehicle, it determines forward or reverse rotation of the drill. In a preferred arrangement, the control lever is duplicated both in a driving cab of the vehicle to control movement of the vehicle and at a control console adjacent the drilling head at the rear end of the vehicle to control rotation of the drill.

In accordance with a further preferred feature, and in order to allow for the different drilling speed ranges required for different types of drilling operation, the hydraulic drive to the drilling head incorporates a change speed gearbox which may have a hydraulically controlled shift. Preferably the gears are selected by two position selectors which are both normally centered in a neutral position by springs and displaced into gear selecting positions by independently controlled hydraulic cylinders so that the selectors may be operated in any desired combination.

According to a further preferred feature of the invention, each wheel of the vehicle is driven by an independent hydraulic motor, and a flow limiting valve is provided in the supply line to each hydraulic motor so that in the event of any wheel slipping or lifting clear of the ground, power will still be available at the other wheels, and the slipping wheel will not spin uncontrollably and thus worsen the lack of adhesion. Drive power may be applied either to the wheels of only one axle, or to all four wheels; the application of drive to all four wheels may be achieved by hydraulically controlling variable capacity drive motors on two of the wheels to change between idling and powered states.

The drilling mast is preferably pivotally mounted on a sub-frame which may be moved horizontally by hydraulic actuating means to provide exact positioning of the drill. The vehicle chassis is preferably further equipped with three hydraulically extensible legs whereby, on reaching a desired drilling station, it may be anchored firmly on the ground and appropriately levelled. The drilling mast, as well as hydraulic drive means for drill bits and hydraulic means for advancing the drive means relative to the mast as drilling proceeds, may also have associated with it hydraulic winches operating conventional block and tackle means for handling drill bits, corers and the like.

Preferably, the drill head itself comprises a hydrostatic motor, a change speed gearbox, and a reduction gear drive to an output shaft through which the drilling torque is applied. Although contrary to normal practice, the use of geared drive throughout instead of the more usual chain drive has the advantage of providing a compact assembly in which adequate thrust bearings may readily be applied to the output shaft. It is found in practice that the drilling heads of such drill units are subjected to considerable abuse, and the compact assembly which can be provided by a geared drive can more easily be engineered to withstand the abnormal stresses to which the head may be subjected when used for purposes which it was not intended.

Further features and details of the invention will be apparent from the following description of a preferred embodiment of the invention.

SHORT DESCRIPTION OF THE DRAWINGS

Figure 4:
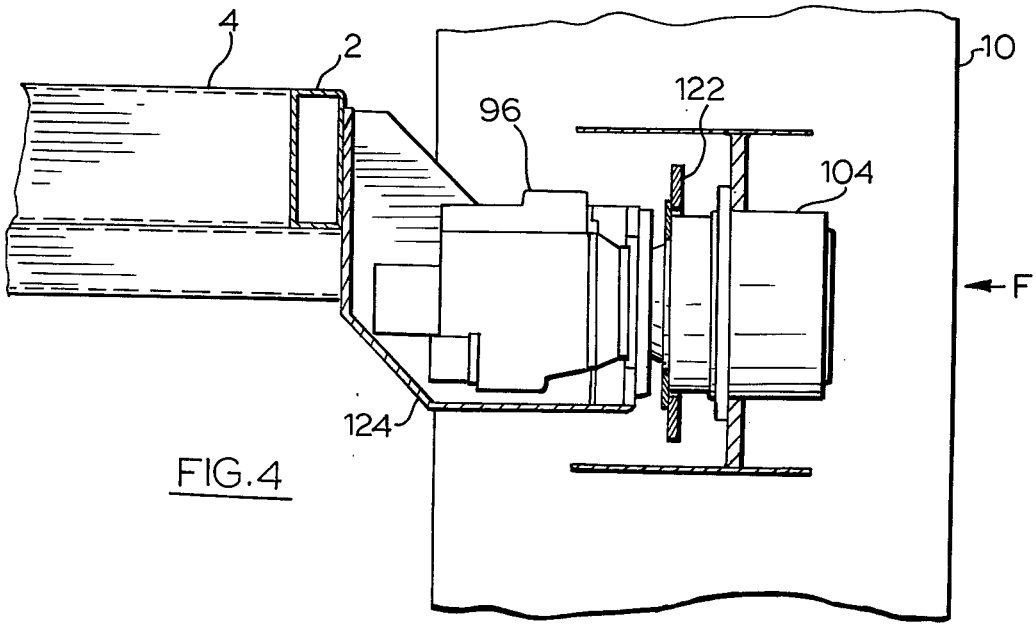
Figure 6:
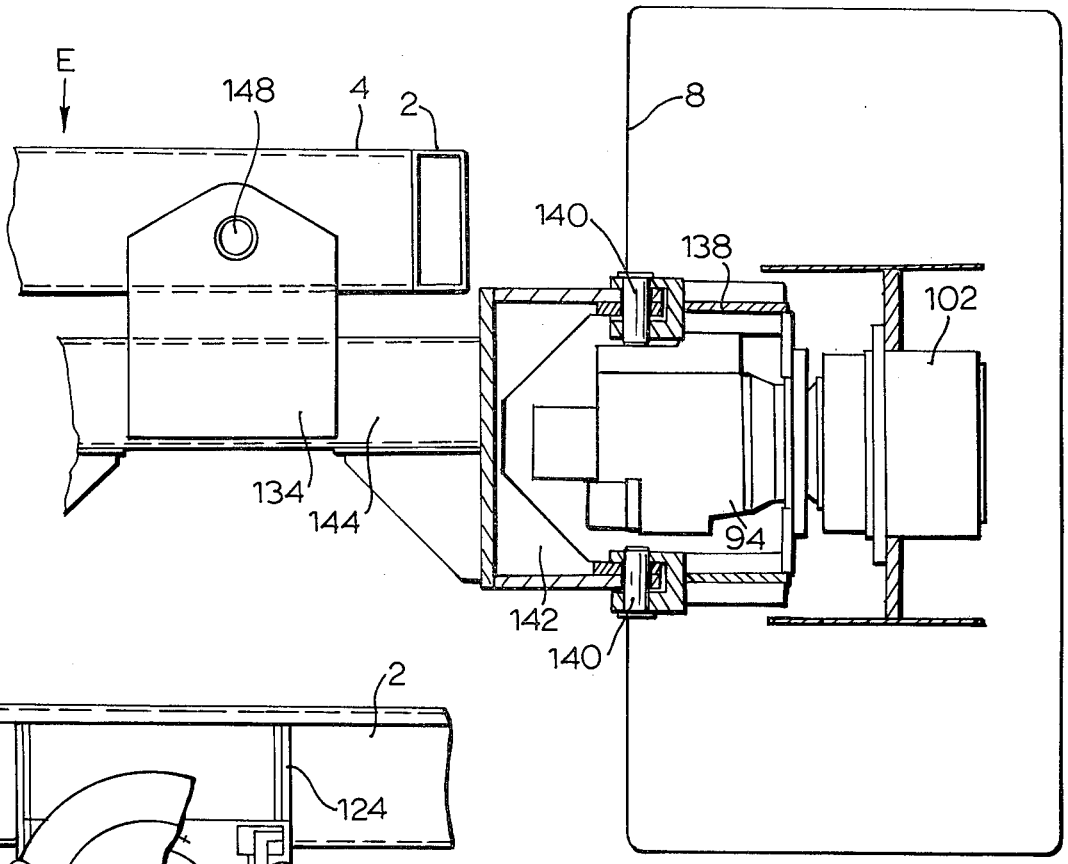
Figure 5:
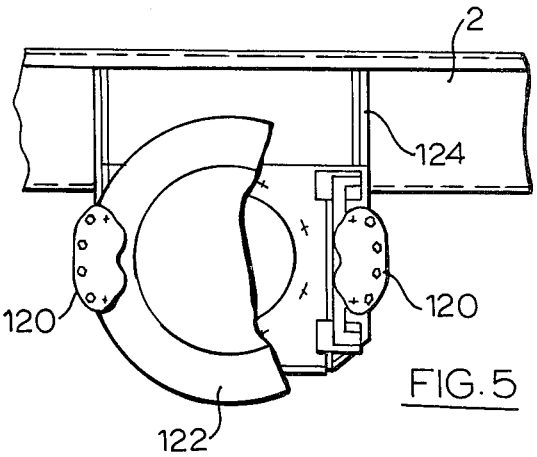
Figure 7:
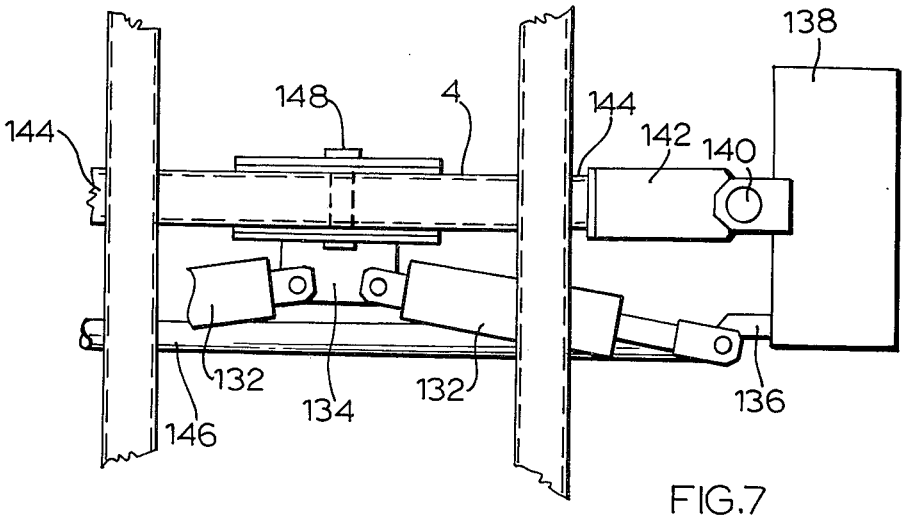
Figure 8:
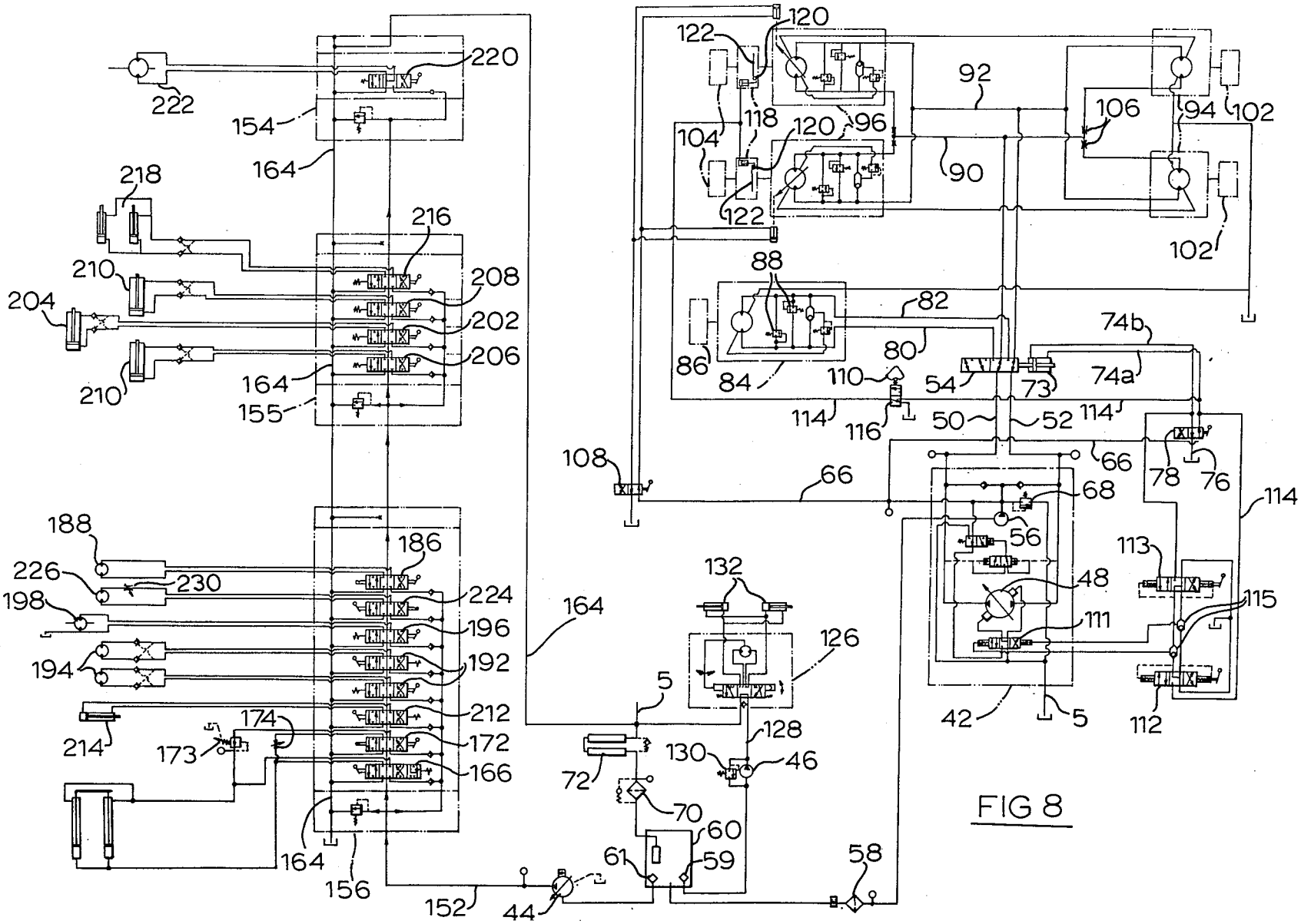

FIG. 4 is a fragmentary vertical section on the centre line of a rear wheel of a vehicle chassis of the unit, FIG. 5 is a view from the direction of the arrow F in FIG. 4, with the wheel and parts of the wheel hub removed for the sake of clarity, FIG. 6 is a fragmentary vertical section on the centre line of a front wheel of the vehicle chassis, FIG. 7 is a fragmentary plan view from the direction of the arrow E in FIG. 6, FIG. 8 is a schematic diagram of the hydraulic circuits of the unit.

DESCRIPTION OF THE PREFERRED EMBODIMENT

Figure 1:
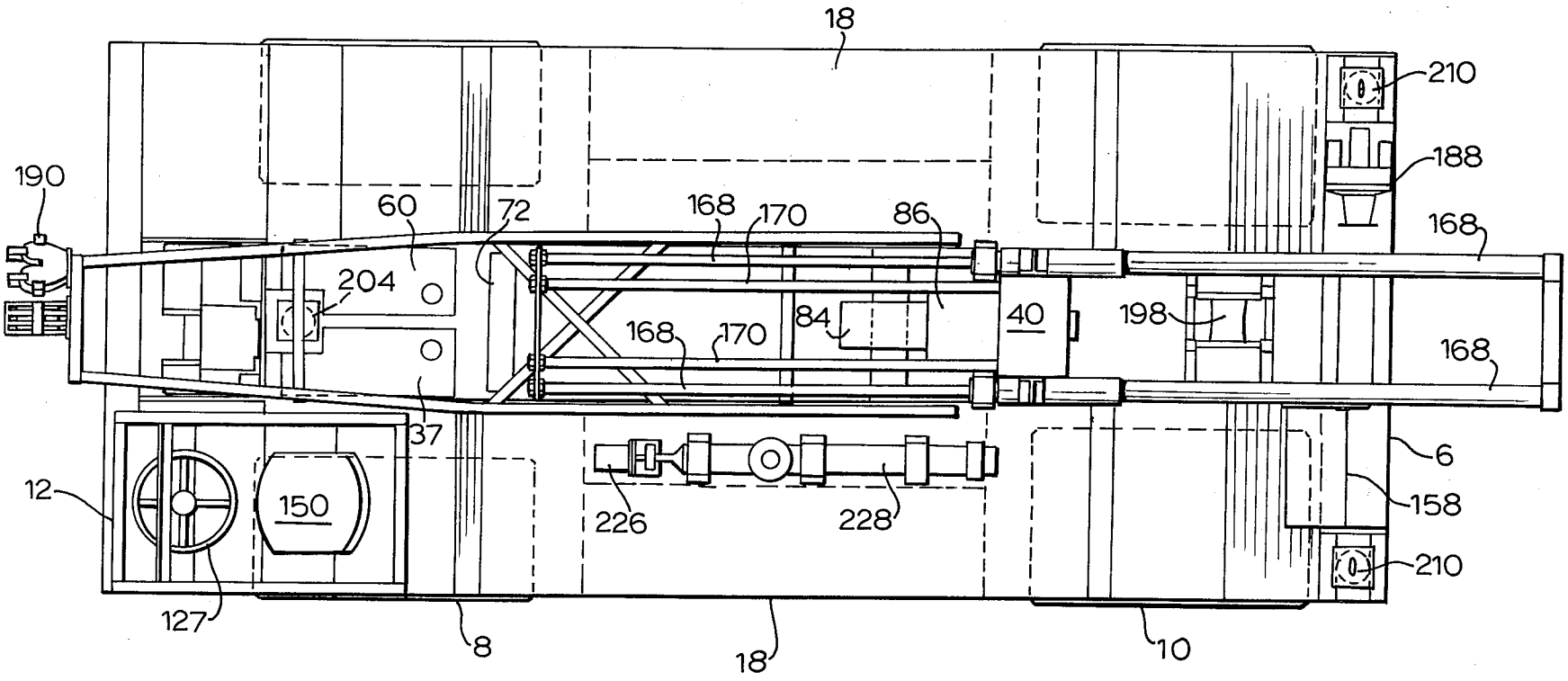
FIG. 1 is a plan view of the drilling unit.
Figure 2:
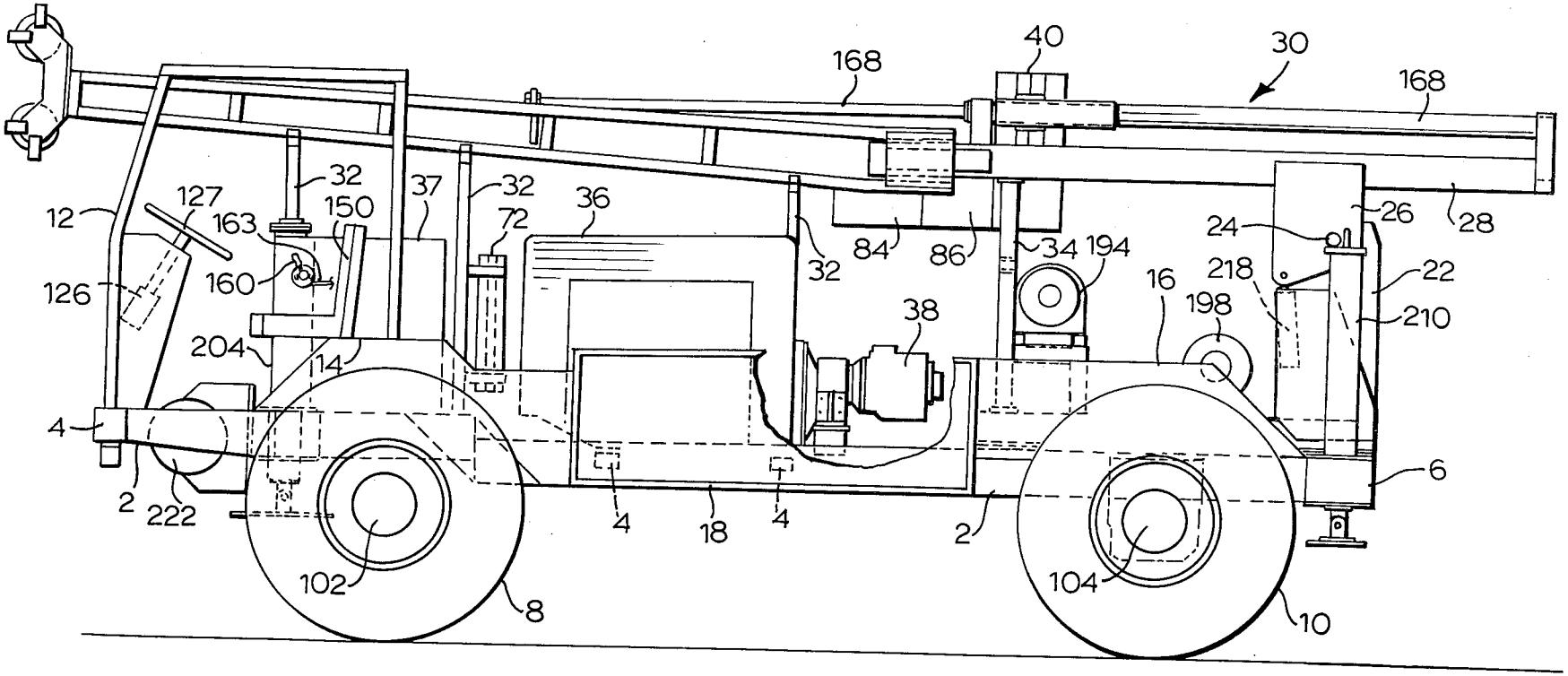
FIG. 2 is a side elevation of the unit.
Figure 3:
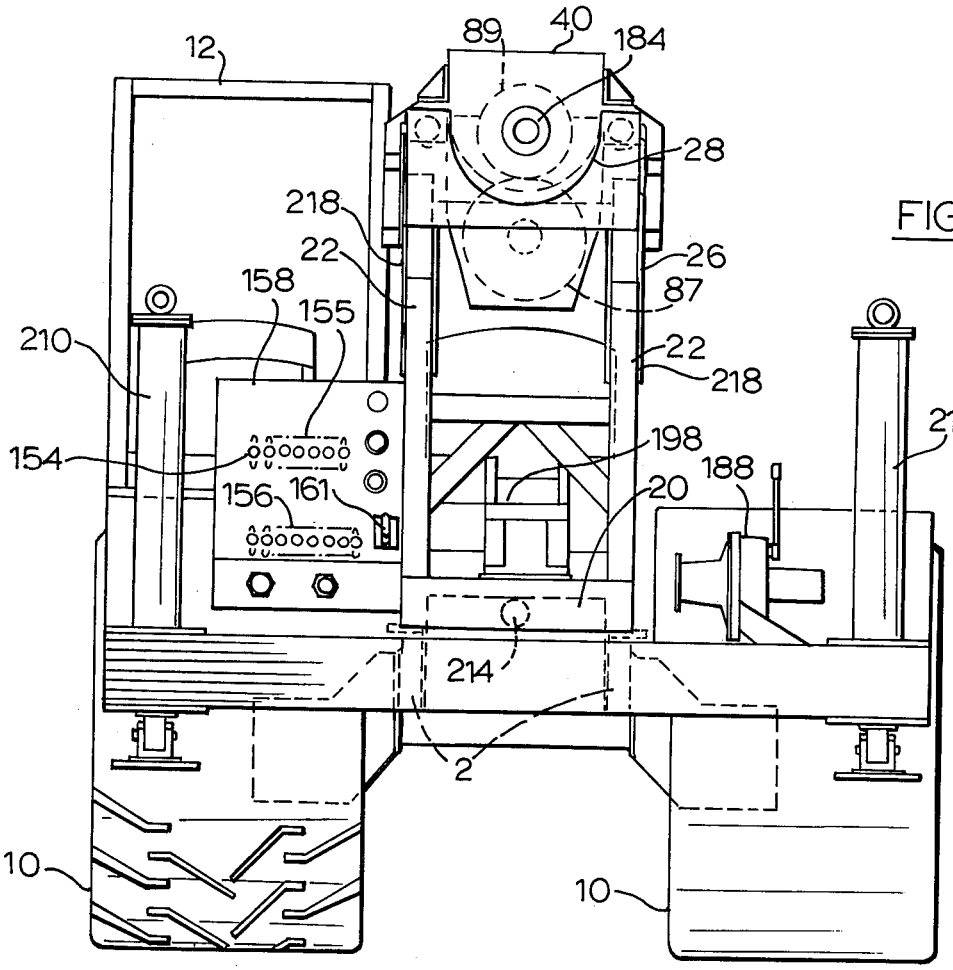
FIG. 3 is a rear elevation of the unit.

Referring now to FIGS. 1 to 3, the drill unit is built upon a ladder-type chassis comprising longitudinal members 2 and cross members 4 and 6, supported on front and rear wheels 8 and 10. Outrigger portions of the cross members 4 and 6 support a cab 12, fenders 14 and 16 and lockers 18 for carrying drills and other accessories. Guided for longitudinal motion relative to the rear of the chassis upon a bed formed by the longitudinal members 2 is a subframe 20 having uprights 22 which support, through pivots 24, brackets 26 attached to a cradle 28 forming part of a drilling mast indicated generally by the reference 30. The mast is normally supported in a horizontal position over the chassis by additional rests 32 and 34 carried by the chassis.

Also carried on the chassis frame is a prime mover in the form of an internal combustion engine 36 supplied with fuel from a tank 37 and coupled to several hydraulic pumps, these pumps being shown generally as an assembly 38.

The various functions of the drilling unit are best described in conjunction with their associated hydraulic circuits, as shown in FIG. 8. A primary hydraulic circuit, providing motive power for the vehicle chassis of the unit and for a drilling head 40 carried by the mast 30 is shown on the right hand side of FIG. 8 and comprises a variable displacement pump unit 42 forming part of the assembly 38. A secondary hydraulic circuit supplied by a constant displacement pump 44 incorporated in the assembly 38 comprises all of the auxiliary functions associated with the drilling function of the rig. These various auxiliary functions will be described further below. An auxiliary pump 46 is provided for use during movement of the vehicle to provide the steering function.

Referring now in more detail to FIG. 8, the pump unit 42 includes a variable displacement pump 48 having output lines 50 and 52 and receiving input oil from a return line 5. In order to provide various control functions described below, an auxiliary pump 56 is provided drawing oil through a filter 58 from a tank 60 (see also FIGS. 1 and 2). The various sumps shown in the diagram are all returned to this tank 60 via an oil cooler 72 (see FIGS. 1 and 2) and a return line filter 70. The output pressure from pump 56 on the line 66 is controlled by means of a relief valve 68. Other details of the pump unit, apart from the control functions discussed below, need not be described in detail since the unit shown is a conventional proprietary item (Eaton transmission pump No. 5420-024).

The lines 50 and 52 are connected to a change-over valve 54 operated by a double acting actuator 73. The control pressure for the actuator 73 is applied through two control lines 74*a* and 74*b* either to the line 66 or to a return line 76 by means of a manually operated changeover valve 78. When the pressure from line 66 is applied to the line 74*b*, the valve 54 is moved to the opposite position from that shown, and the lines 50 and 52 are connected by lines 80 and 82 to a constant volume hydraulic motor unit 84, which drives the drill head 40 through a gearbox 86 and reduction gears 87 and 89. Overloads on the gearbox and motor transferred back from the drill head are prevented by back-to-back pressure relief valves 88.

When pressure from the line 66 is applied to the line 74*a*, the valve 54 assumes the position shown, thus connecting the lines 50 and 52 to fixed volume hydraulic motors 94 and variable volume hydraulic motors 96 through lines 90 and 92. The motors 94 drive the front wheels 8 through reduction hubs 102, and the motors 96 drive the rear wheels 10 through reduction hubs 104 (see FIGS. 4 and 5). A manually operated changeover valve 108 connected to the line 66 controls double acting actuators operating the flow controls on the motors 96 so as to move these between neutral and full flow, so as to provide either two or four wheel drive. The maximum flow of oil to the motors 94, 96 driving the individual wheels is limited by flow restrictors 106. In the event of one driven wheel losing adhesion, the presence of the flow restrictor 106 associated with that wheel prevents its associated motor from hogging the entire oil supply, and ensures that traction is maintained on the other wheel or wheels. Obviously, the relative calibrations of the various restrictors may be varied should it be desired to redistribute the maximum oil flows permitted to each wheel.

The line 66 also supplies, via the valve 78 and line 114, a brake valve 116 by means of which hydraulic pressure may be applied to or released from cylinders 118 operative to release normally applied disc brakes 120 (see FIG. 5) acting on brake discs 122 attached to the hubs 104 (see FIGS. 4 and 5) As will be seen from FIGS. 4 and 5, the hubs 104 and motors 96 for the rear wheels 10 are supported by brackets 124 on the longitudinal members 2 of the chassis. Since pressure is applied via the valve 78, the brakes can only be released when this valve is positioned so that the valve 54 applies fluid pressure to the wheel motors 94, 96.

The valve 116 is actuated by a cam 110 having a center dwell and ganged with a two way proportioning valve 112 which also has pressure applied thereto via the valve 78 and the line 114. The arrangement is such that the valve 116 is closed when the proportioning valve is closed, and open when the proportioning valve is opened in either direction. The proportioning valve acts upon opening so as to move a control valve 111 in the pump unit 42 proportionately in a corresponding direction so as in turn to set up a proportionate pressure differential between the lines 50, 52, the sense of the differential being in accordance with the direction of opening of the valve 112. Hence movement of the valve 112 out of its closed position releases the brakes 120 and progressively applies power to the vehicle wheels so as to drive the vehicle in either direction according to the direction of movement of the valve.

When the valve 78 is reversed, control pressure is applied to a two way proportioning valve 113 ganged with the valve 112, which then operates in the same way as the valve 112 to apply the variable and reversible differential output from the pump 48 to the drill head motor 84. Two way check valves 115 act to isolate that one of the valves 112, 113 to which pressure is not applied.

Referring now to the lower center portion of FIG. 8, the pump 46 draws oil from the tank 60 through a filter 59, and delivers it to a steering control unit 126 (see also FIG. 2) through a line 128 in which the pressure is controlled by a relief valve 130. The steering control unit 126 is conventional, and selectively supplies oil to two steering actuators 132 (see FIG. 7). Referring to FIGS. 6 and 7, the actuators 132 act between a bracket 134 and steering knuckles 136 welded to the sides of cylindrical drums 138 which house the motors 94. Diametrically opposite points at the top and bottom of the drums are connected by king pins 140 and forks 142 to a front axle 144 to the center point of which the bracket 134 is attached. The knuckles 136 are connected by a tie rod 146 so as to complete an Ackerman steering linkage, and the bracket 134 is pivotally connected to a cross member 4 of the chassis by a pivot pin 148 so as to permit the axle to rock laterally relative to the chassis. Since the rear wheels are fixed relative to the chassis, this enables the front axle to move to accommodate unevenness in the terrain without influencing the steering. The steering unit 126 is connected to a steering wheel 127 appropriately positioned relative to a driver's seat 150 in the cab 12, and an appropriate feedback connection is established between the front wheels and the steering unit 126 to control the pressure applied to the cylinders 132.

Referring now to the left hand portion of FIG. 8, the pump 44 draws oil from the tank 60 through a filter 61, and supplies pressurized oil via the line 152 to the various auxiliary functions associated with operation of the unit in its drilling mode. Oil from the line 152 is applied to the various auxiliaries by means of valves assembled into banks 154, 155 and 156. These valve bank assemblies are mounted on a control panel 158 at the rear of the vehicle chassis adjacent the operating position of the drilling mast 30. The control panel 158 also carries a lever 161 operating the valves 112 and 113 for the variable volume pump unit 42 via a cable, a further lever 160 also operating the valves 112 and 113 via a cable 163 being provided in the cab 12. The control function is such that in the mid position of the control levers 160, 161, the output pressure from the pump 48 is the same on both lines 50 and 52, and movement in opposite directions from the central position produces a pressure differential between the two lines in a sense depending on the direction of movement of the lever. The valve 78, determines whether the levers 160, 161 control the drill head 40 or the motors 94, 96.

All the auxiliary functions save the water pump referred to below are powered by double acting linear hydraulic actuators or reversible hydraulic motors. The individual valves in the banks 154, 155 and 156 each have three positions, a first position in which one output line is connected to the line 152 and the other line to a return line 164, an intermediate position in which both output lines are either blocked, and a third position in which the one line is connected to the line 164 and the other line to the line 152.

The valves in the bank 156 control various functions mainly associated with the operation of the drilling head 40. A valve 166 controls two actuators 168 which move the head 40 longitudinally of the mast 30 on guides 170 (see FIGS. 1 and 2). A second valve 172 is connected in parallel with the valve 166 but is in series with a flow restrictor 174 and a relief valve 173; the valve 172 may be used when it is desired to move the drill head at a lower rate, as during actual drilling, whilst the valve 173 limits the thrust applied to the drill. A fourth position of the valve 166 allows the actuators to permit the drill head to move downwards under gravity, but not in the opposite direction.

Valves may be provided to control double acting cylinders which operate the selectors in the change speed gearbox 86 so as to alter the ratio of the gearing between the motor 84 and the output shaft 184 of the drill head 40, or these selectors may be operated manually.

The valve 186 controls a cat head winch 188 mounted on the cross member 6, which is used in conjunction with a cat head 190 in the fitting and removal of drill bits and the like in and from the drilling head 40.

Two valves 192 control two boom winches 194, and a valve 196 controls a further winch 198 on the carriage 20. All of these three winches are used in connection with the handling of drill bits, tubes, corers and the like in association with the drilling mast.

Considering now valves comprised by the valve bank 155, the valve 202 controls a levelling jack 204 at the front of the vehicle, whilst valves 206 and 208 control levelling jacks 210 at the rear of the vehicle and extending through the cross member 6.

A valve 212 in the bank 156 controls an actuator 214 controlling longitudinal movement of the carriage 20, and a valve 216 controls two actuators 218 acting between the platform 20 and the bracket 26 so as to tilt the mast 30 to any desired angle.

The valve 220 in the bank 154 controls an additional winch 222 at the front of the vehicle, and the valve 224 in the bank 156 controls a hydraulic motor 226 driving a water pump 228 used either to supply water for use during a drilling operation, or for extracting excess water as necessary. A variable restrictor valve 230 is provided in series with the pump motor so as to control the pump output.

In use, the drilling unit is driven to a drilling site in the condition shown in FIGS. 1 to 3, that is with the drilling mast resting horizonally on the supports 32. The valve 78 is positioned so that the output of the pump 48 is applied to the wheel motors, the valve 108, which is located in the cab, being positioned either so as to cause the rear wheel motors 96 to idle, or to cause both the motors 96 and the front wheel motors 94 to be powered if four wheel drive is required by terrain conditions. The velocity of the vehicle is controlled by the lever 160 in the cab, which is disposed so that forward movement of the lever causes the vehicle to move forward at a rate dependent on the degree of movement of the lever, and rearward movement causes the vehicle to move rearward according to the degree of rearward movement of the lever. Any additional braking effort which may be required to bring the vehicle to a halt is automatically applied by the brakes 120 when the pressure in the brake cylinders is released by the valve 116 as the lever 160 is returned to its center position. Thus the brakes cannot be released unless the vehicle is powered. On arrival at the site, the vehicle is manoeuvered, using either the lever 160 or the lever 161, as is convenient, so that the rear of the mast 30 is in line with the desired point of entry of the drilling to be made, and the operator then reverses the valve 78. The levelling jacks 204 and 210 are extended so as to support the vehicle firmly on the ground and level the chassis, using the appropriate control valves in the bank 155, and the control valve 216 is used to extend the actuators 218 to whatever extent is necessary to bring the mast 30 to a desired drilling angle. This will normally be vertical, with the cradle at 28 adjacent the supports 22, but it is an important advantage of the unit that other angles may equally readily be employed if desired. When the required angle has been reached, the mast is locked in position by returning the valve to its intermediate, locked position. Drill bits and the like, according to the operation being carried out, may be fitted to the drill head 40 using the various winches 188, 194 and 198, and an appropriate ratio selected in the change speed gearbox 86 by use of selectors. The lever 161 may then be used to control clockwise and anti-clockwise rotation of the drill shaft 184 in a similar manner to that described with reference to the forward and rearward movement of the vehicle, the valve 78 having previously been operated so as to connect the pump 48 to the motor unit 84. The drill may be advanced to a drilling position by means of the valve 166, and precisely positioned over the required point of entry by using the valve 212 to control the actuator 214 moving the carriage 20. During drilling, the drill may be advanced by the actuators 168 under the control of the valve 172, or by gravity under the control of the valve 166 in its fourth position. When it is required to change or extend a drill or the like, the drill head may be withdrawn up the mast by the actuators 168 under control of the valve 166, and the necessary exchange of bits or insertion of extensions handled using the various winches. Any necessary supply or removal of water or mud during the drilling operation can be carried out using the pump 228.

On completion of the drilling operation, the drills and the like may be stowed in the lockers 18, the platform 20 retracted, and the drilling mast returned to its horizontal position, the jacks 204 and 210 retracted, and the valve 78 again reversed so that pressurized oil is available for supply to the wheel motors so that the unit may be moved to another drilling site or returned to base. The winch 222 may be utilized if necessary to assist in crossing particularly difficult terrain, or in clearing sites prior to drilling.

What I claim is:

1. In an all terrain drill unit comprising an all terrain vehicle chassis, propulsion means for said chassis, a drilling mast mounted on the chassis for movement between a horizontal position overlying the chassis and a vertical position overhanging the chassis, a drilling head carried by the drilling mast, and a power source on the chassis for the drilling head, the improvement wherein first hydraulically operated actuator means is provided linked to the drilling mast and chassis for moving the former to any location between its horizontal and vertical positions inclusive, second hydraulically operated actuator means is provided linked to the drilling mast and the drilling head for moving the latter longitudinally of the mast, third hydraulically operated actuator means is provided on the vehicle chassis to locate the latter in a desired drilling attitude, and a first hydraulic pump is fluid linked to said actuator means to supply pressurized hydraulic fluid thereto, wherein the power source for the drilling head is a second variable displacement hydraulic pump which is alternatively a power source for the propulsion means for the vehicle chassis and is controllable independently of said first hydraulic pump, wherein the actuator unit for said drilling head is a reversible drive motor and the propulsion means for said vehicle chassis are a plurality of wheels each associated with a reversible hydraulic drive motor, and wherein control valve means are provided through which the second hydraulic pump is selectively fluid linked to said motors for said drilling head and said vehicle chassis, said control valve means comprising a first control valve means adapted to reverse said motors and having a neutral position, and second control valve means directing fluid either to said drill head motor or to said wheel drive motors.

2. A unit according to claim 1, wherein the drilling head further comprises a change-speed gearbox receiving an input from the drive motor, and a reduction gear drive applying the output of the gearbox to an output shaft, the drive being transmitted from the motor to the output shaft through directly meshing gear wheels.

3. A drill unit according to claim 1 or 2, wherein the unit has a driving cab on said chassis and a control unit on said chassis adjacent said drilling head and remote from the driving cab, and said first pump and said first control valve means have manual control means duplicated in said cab and at said control unit.

4. A unit according to claim 1, wherein a flow limiting valve is included in a hydraulic supply line from the control valve means to each wheel drive motor.

5. A unit according to claim 4, wherein the motors associated with certain of said wheels are variable capacity motors, whereby the torque applied to said certain wheels may be changed relative to the torque applied to the remainder of said wheels.

6. A unit according to claim 1 or 2, wherein the drilling mast is mounted on a sub-frame, and hydraulically operated actuator means, fluid linked to said first hydraulic pump, is provided between the chassis and subframe whereby to control the position of the latter on the chassis.

* * * * *